US009038847B2

(12) United States Patent
Hewitt et al.

(10) Patent No.: US 9,038,847 B2
(45) Date of Patent: May 26, 2015

(54) INSULATED BEVERAGE APPARATUS AND COOLING DEVICE

(71) Applicant: Hewy Wine Chillers, LLC, Orlando, FL (US)

(72) Inventors: Benjamin R. Hewitt, Orlando, FL (US); David J. Fedewa, Haslett, MI (US); Roy P. Prosise, Cedar Park, TX (US); Dan Caputo, Cedar Park, TX (US)

(73) Assignee: Hewy Wine Chillers, LLC, Orlando, FL (US)

( * ) Notice: Subject to any disclaimer, the term of this patent is extended or adjusted under 35 U.S.C. 154(b) by 0 days.

(21) Appl. No.: 14/204,449

(22) Filed: Mar. 11, 2014

(65) Prior Publication Data

US 2014/0284342 A1 Sep. 25, 2014

Related U.S. Application Data

(60) Provisional application No. 61/777,840, filed on Mar. 12, 2013.

(51) Int. Cl.
*B65D 81/38* (2006.01)
*A47G 23/02* (2006.01)

(52) U.S. Cl.
CPC ..... *B65D 81/3881* (2013.01); *A47G 23/02* (2013.01); *A47G 23/0266* (2013.01); *A47G 2023/0275* (2013.01)

(58) Field of Classification Search
CPC ..... B65D 81/3881; B65D 81/3883; B65D 81/3876; B65D 81/3886; A47G 19/2288; A47G 19/2205; F25D 3/08; F25D 2331/805
USPC ..... 220/592.24, 592.2, 739, 737, 903; 62/457.4, 457.3, 457.2, 457.1
See application file for complete search history.

(56) References Cited

U.S. PATENT DOCUMENTS

| | | | | |
|---|---|---|---|---|
| 3,285,455 | A | 11/1966 | Pewitt | |
| 3,302,428 | A * | 2/1967 | Paquin et al. | 62/457.4 |
| 4,163,374 | A | 8/1979 | Crisman et al. | |
| 4,255,944 | A * | 3/1981 | Gardner et al. | 62/457.8 |
| 4,344,303 | A | 8/1982 | Kelly, Jr. | |
| 4,383,422 | A | 5/1983 | Gordon et al. | |
| 4,540,611 | A | 9/1985 | Henderson | |
| 4,745,776 | A * | 5/1988 | Clark | 62/457.4 |
| 4,771,911 | A * | 9/1988 | Morony et al. | 220/592.16 |
| 4,782,670 | A * | 11/1988 | Long et al. | 62/457.4 |
| 4,989,415 | A * | 2/1991 | Lombness | 62/372 |
| 5,271,244 | A * | 12/1993 | Staggs | 62/457.3 |
| 5,272,890 | A * | 12/1993 | Penxa | 62/457.4 |

(Continued)

OTHER PUBLICATIONS

International Search Report with regard to International Application PCT/US2014/023378, dated Jul. 16, 2014.

*Primary Examiner* — Robert J Hicks
(74) *Attorney, Agent, or Firm* — Abel Law Group, LLP

(57) ABSTRACT

A device for a beverage container may include a tubular member that is insulated and has an axis. The tubular member may further include an upper axial end and a lower axial end. Both the upper and lower axial ends can be open. The tubular member may be configured to receive and insulate the beverage container therein. The device may include a base. The base may be removably coupled to the lower axial end of the tubular member to close the lower axial end. The base may include an interior compartment containing a fluid permanently sealed therein. The fluid can have a freezing point of about 0° C. or less.

18 Claims, 7 Drawing Sheets

(56) References Cited

U.S. PATENT DOCUMENTS

| | | | | |
|---|---|---|---|---|
| 5,331,817 | A | 7/1994 | Anthony | |
| 5,394,703 | A | 3/1995 | Anthony | |
| 5,653,124 | A * | 8/1997 | Weber | 62/457.4 |
| 5,909,821 | A | 6/1999 | Guridi | |
| D442,833 | S | 5/2001 | Shuman | |
| 6,357,253 | B1 * | 3/2002 | Condy | 62/457.8 |
| D455,052 | S | 4/2002 | Gullickson et al. | |
| D455,612 | S | 4/2002 | Gullickson et al. | |
| 6,474,499 | B2 | 11/2002 | Donelson et al. | |
| 6,626,326 | B2 | 9/2003 | Murakami | |
| 6,634,417 | B1 * | 10/2003 | Kolowich | 165/10 |
| 6,786,062 | B1 | 9/2004 | Greenberg | |
| 7,124,604 | B2 | 10/2006 | Taylor et al. | |
| 7,331,194 | B2 | 2/2008 | Lefkowitz et al. | |
| 7,712,625 | B2 | 5/2010 | Alger | |
| 7,942,145 | B2 | 5/2011 | Palena et al. | |
| 8,162,170 | B1 | 4/2012 | Massad | |
| 2004/0065109 | A1 * | 4/2004 | Metcalf | 62/457.3 |
| 2007/0045215 | A1 | 3/2007 | Holley, Jr. | |
| 2008/0302127 | A1 * | 12/2008 | Cote | 62/457.7 |
| 2009/0050636 | A1 * | 2/2009 | Sanchez | 220/592.24 |
| 2010/0005828 | A1 | 1/2010 | Fedell | |
| 2014/0209610 | A1 * | 7/2014 | Plott et al. | 220/289 |

* cited by examiner

INSULATED BEVERAGE APPARATUS AND COOLING DEVICE

This application claims priority to and the benefit of U.S. Prov. App. No. 61/777,840, filed Mar. 12, 2013, and is incorporated herein by reference in its entirety.

BACKGROUND OF THE INVENTION

1. Field of the Disclosure

The present invention relates in general to devices for beverages and, in particular, to a cooling device and insulated system for a beverage container.

2. Description of the Related Art

Many beverages are meant to be consumed at a desirable temperature range, whether it be hot, cold, or room temperature. The temperature of the beverage impacts taste, quality, texture, and overall experience. For example, coffee and teas can be served hot. After the temperature drops, they may be considered less desirable. Beer and soda are often intended to be consumed at a very cold temperature. Ice is often used to maintain cold temperatures. However, using ice has several drawbacks, such as the need to transfer the beverage from its original container into a glass or cup so ice can be added. This process immediately impacts carbonation levels causing the beverage to go "flat" quickly. Adding ice further advances the reduction in carbonation, and the melting ice adds water to increase the rate to flatness. This process also changes the character and flavor of the beverage. Ice is rarely used in direct contact with beer since the ice undesirably dilutes the beverage.

Beverage containers such as cans are desirable vessels for ease of transport, light weight and cost, but they do not keep beverages cold as well as other more expensive materials, such as glass. A particular concern for beverages served in cans is that the heat capacity of cans is far less than glass. However, glass has its own issues because of cost, weight, and breakability. This makes the transportation requirements for glass more challenging.

Insulated sleeves or jacket coozies have been used on bottles and cans for the purposes of keeping the beverage container cold or hot. Such sleeves also reduce condensation and prevent heat or cold transfer to the hand of the user. Some sleeves are concerned primarily with insulation, such as those made from Styrofoam, neoprene or the like, while fabric or knitted sleeves are more about the feel and look of the cozy, but offer less insulation. Thus, improvements in beverage container insulation devices continue to be of interest.

SUMMARY

Embodiments of a cooling device and insulated system for a beverage container are disclosed. For example, a device for a beverage container may include a tubular member that is insulated and has an axis. The tubular member may further include an upper axial end and a lower axial end. Both the upper and lower axial ends can be open. The tubular member may be configured to receive and insulate the beverage container therein. The device may include a base. The base may be removably coupled to the lower axial end of the tubular member to close the lower axial end. The base may include an interior compartment containing a fluid permanently sealed therein. The fluid can have a freezing point of about 0° C. or less.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
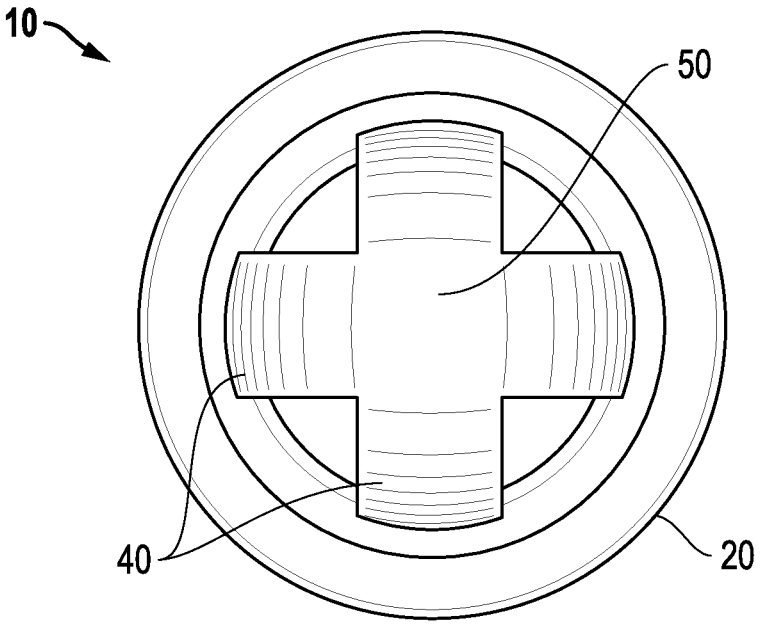
FIG. 1 is a top view of an embodiment of a device for a beverage container.
Figure 2:
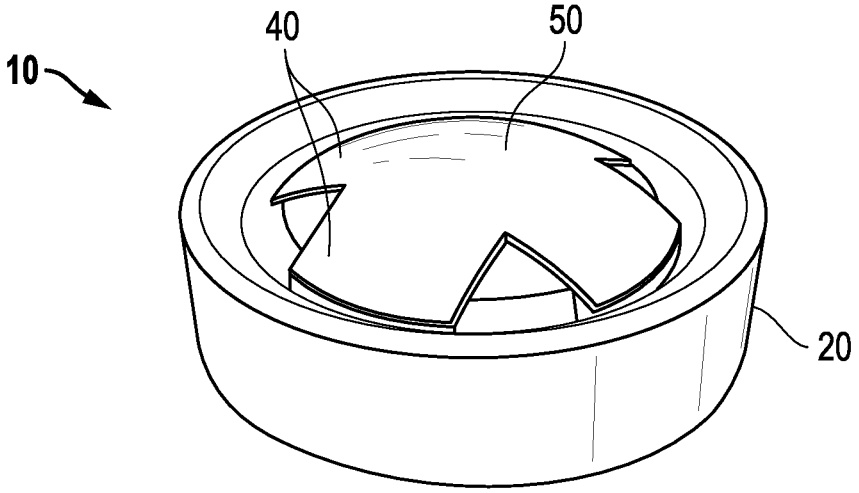
FIG. 2 is a top perspective view of an embodiment of the device of FIG. 1.
Figure 3:
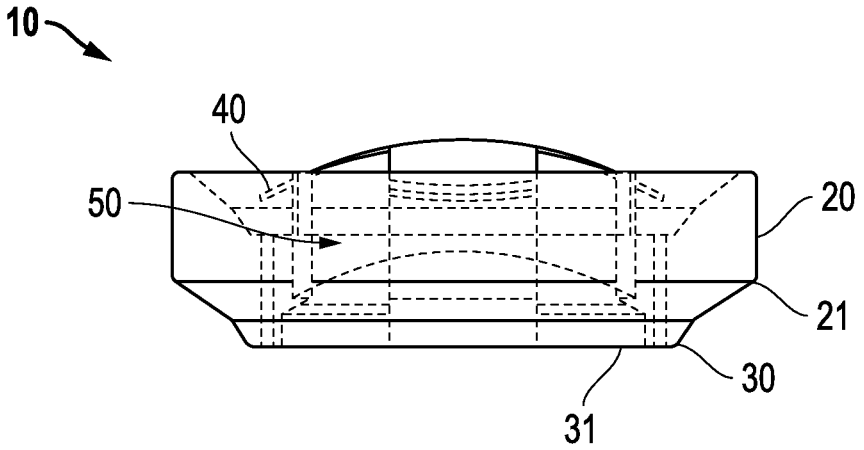
FIG. 3 is a side view of an embodiment of the device of FIG. 1.
Figure 4:
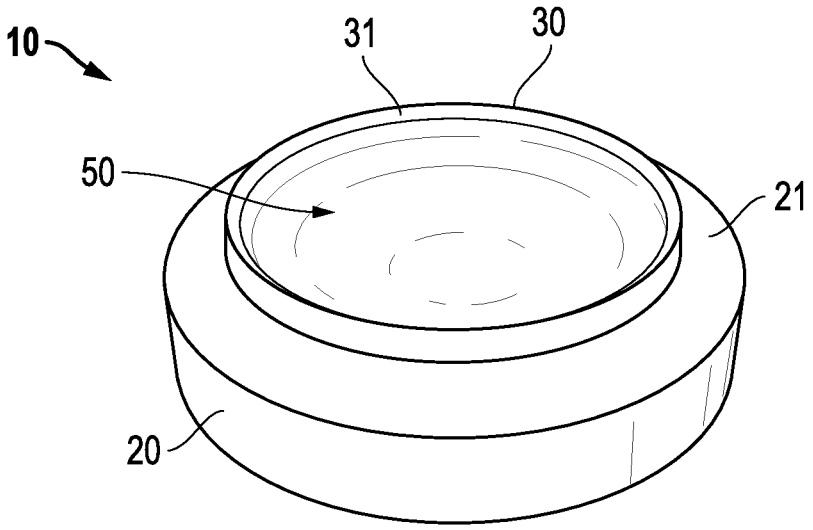
FIG. 4 is a bottom perspective view of an embodiment of the device of FIG. 1.

Embodiments of a cooling device and insulated system for a beverage container are disclosed. The present disclosure generally relates to a device for maintaining a desired temperature of a beverage within a vessel. In an example, the device helps to maintain the temperature of the beverage within the vessel for an extended period of time. In a particular example, the beverage within the vessel is meant to be relatively cold and the device is operable to maintain the beverage within a relatively cold or cool temperature range. A device according to the present disclosure includes a sidewall extending upward from a base. The device may include engagement wings protruding from the sidewalls. An insulating substance or liquid may be provided within the device.

In some versions, an object of the present disclosure is to provide a device for cooling canned beverages. Another object can be to provide a device for cooling canned beverages that attaches to a canned beverage container or vessel.

Other objects and advantages of the present invention will be understood by those of ordinary skill in the art. This disclosure may be embodied in the form illustrated in the accompanying drawings, attention being called to the fact, however, that the drawings are illustrative only, and that changes may be made in the specific construction illustrated and described within the scope of this application.

FIGS. 1-4 depict an embodiment of a device 10 including a sidewall 20 that extends relatively upward from a base 30. The sidewall can be vertical walls or semi vertical walls. Optional engagement wings 40 extend upward from the base surrounded by the sidewalls forming a cavity or opening adapted to receive a portion of a beverage container or vessel. The engagement wings 40 are sized and shaped to engage an interior surface of a standard beverage can. A cooling substance 50 may be provided within the device 10. In an example, sidewall 20 defines a slope 21 at a lower portion of the sidewall 20. The base 30 is formed to securely rest on a surface such as a table.

Turning now descriptively to the drawings, in which similar reference characters denote similar elements throughout the several views, the figures illustrate an embodiment of the device 10, sidewall 20, base 30, engagement wings 40 and substance 50 inside of device 10.

Embodiments of the device 10 may be used to cool a canned beverage. The function of the device 10 may include users attaching it to a canned beverage to cool. Example cans include standard 12 ounce beer or soda cans. Other sizes and shapes exist that will function with the device 10 in similar manner.

Other embodiments of the device 10 can include a substance 50 such as a liquid, gel, solid, or combination thereof. The substance can be modifiable by cooling or heating. In an example, the substance 50 is suitable to having a phase change such as being frozen or at least cooled to a desired temperature. In a further example, the substance defines a thermal capacity greater than that of a beverage can and can be adapted to reduce heat transfer to and from the can.

Embodiments of device 10 can be made out of various plastics and/or metals and filled with various substances 50. The sidewall 20 of the device 10 defines a structure that extends from base 30. In this example, sidewall 20 is rounded and defines a lower end slope 21 that angles relatively inward from an axis defined by sidewall 20. Having an angled slope 21 allows for devices 10 to be stackable. This design can enhance the commercial desirability of device 10 for transportation and other uses.

In an example, device 10 is constructed to fully enclose substance 50 which is provided inside sidewall 20 and engagement wings 40. Sidewall 20 can be composed of various materials and can define many different shapes and geometries. Base 30 of device 10 is formed integral with sidewall 20 and engagement wings 40. Base 30 can be formed of any suitable material, particularly a material that allows for heat transfer from the substance 50 to a beverage container. Base 30 can also define a plurality of shapes and geometries. Base 30 can be sized and shaped to allow for resting on a given surface, particularly when device 10 is engaged to a particular beverage container, such as a can.

Embodiments of engagement wings 40 can protrude from the device 10 in an upper region opposite the base 30. Engagement wings 40 can be formed of any material and in this example is integral with the base 30 and sidewall 20. The engagement wings 40 are sized and shaped to engage and securely attach to a beverage container, particularly a bottom of a beverage container, and even more particularly a metal can beverage container.

In some versions, the substance 50 can be provided within device 10. The substance can be composed of any material that can change in temperature. In an example, the substance 50 is water and in another example, the substance 50 is BLUE-ICE. Device 10 having substance 50 can be frozen or chilled using a freezer or cooler. The colder device 10, in use, will allow for the cooling or maintaining the beverage within a corresponding beverage container. Heat transfer from the warmer environmental conditions to the colder beverage is thus reduced and colder temperature of the container remains for a longer period of time compared to having no device 10.

Embodiments of the device 10 can include one or more sidewalls 20 that can extend upwardly from a base 30. The engagement wings 40 protrude up from base 30 on an opposite side extending upward surrounded by sidewall 20 and forming an opening or a cavity between sidewall 20 and engagement wings 40. The cavity should be sized and shaped to receive a bottom rim of a beverage container. Substance 50 is provided inside device 10.

In an embodiment, the ends of the engagement wings 40 can include a profile that allows them to flex and press onto (i.e., grip) a can. Thus, the device 10 can be selectively retained on the can, such as by compression and 'biting' the can. The wings can be spring-biased. In another example of the present disclosure, a twisted sidewall or twisted engagement wings can be formed to allow for twisting engagement with a beverage container. The engagement wings 40 may include an angled edge to allow the can to be pressed onto and then unscrew from the engagement wings 40. Another example includes a suction cup embodiment that attaches the device to canned beverages. In yet a further example, of the present disclosure, an elastic ring is provided that can replace or supplement the engagement wings to attach to canned beverages.

When using the alternative embodiments that can be twisted-on, the device can be pushed and/or twisted onto the bottom of a canned beverage. For a suction cup, the device can be pushed onto the bottom of a can to engage the suction cup and making it stick on the bottom of a can. Using an elastic ring, spanning the differences in can size can be achieved making it so that the device attaches to various canned beverages.

Figure 5:
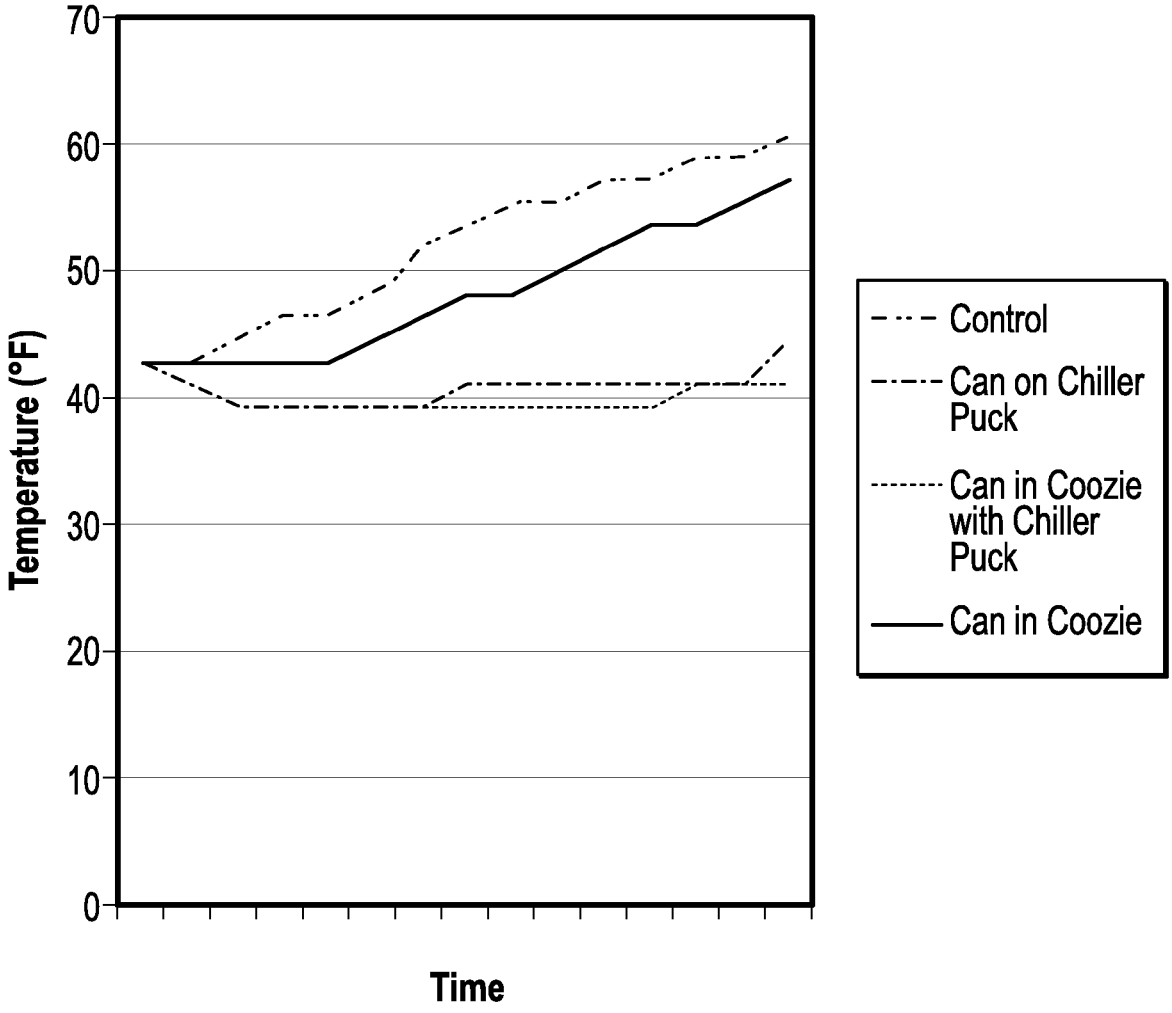
FIG. 5 is a plot illustrating beverage temperature versus time using an embodiment of the device of FIG. 1, compared to other beverage container options.
Figure 6:
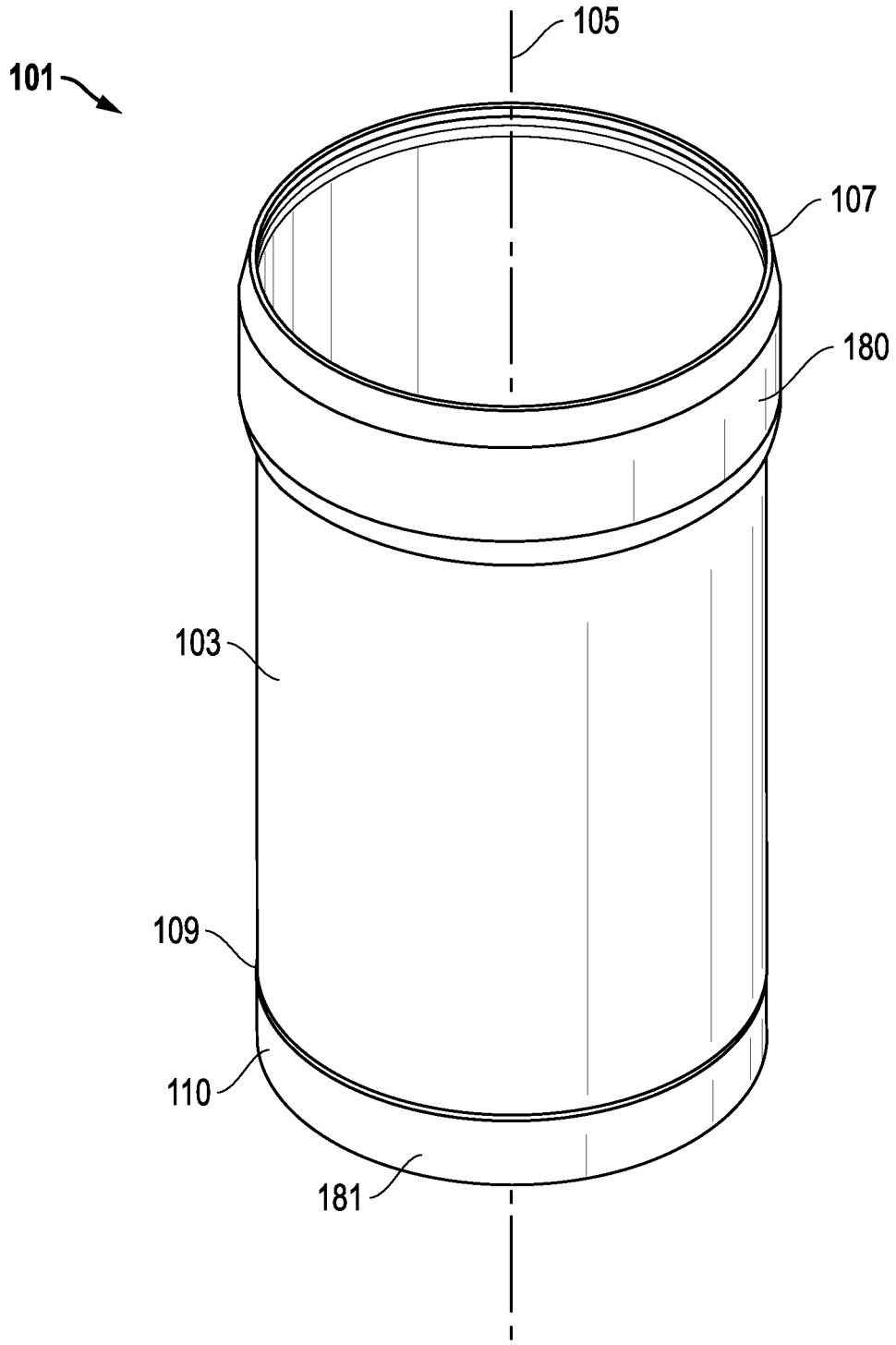
FIG. 6 is a top perspective view of another embodiment of a device.
Figure 7:
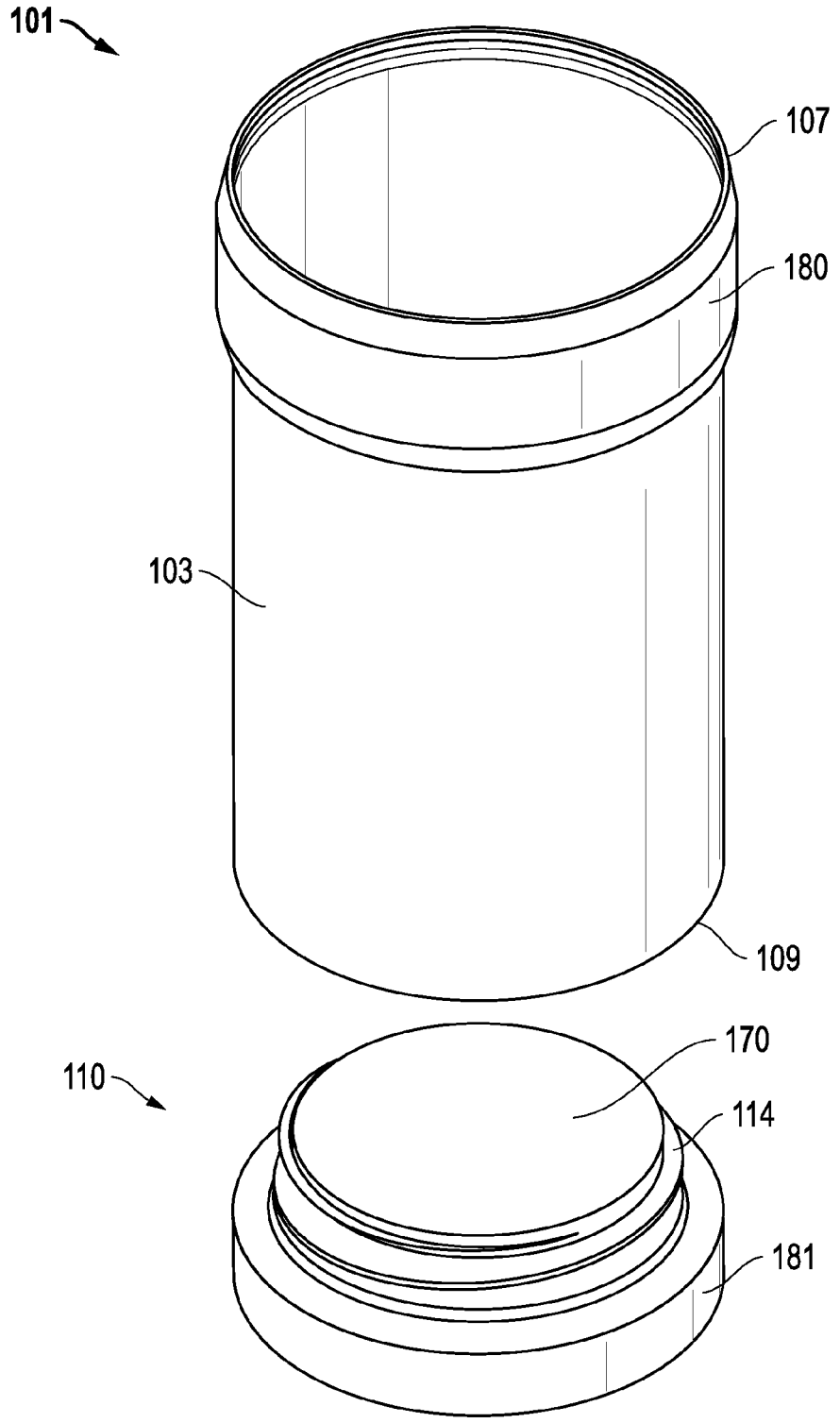
FIGS. 7 and 8 are exploded, top and bottom perspective views of an embodiment of the device of FIG. 6.
Figure 8:
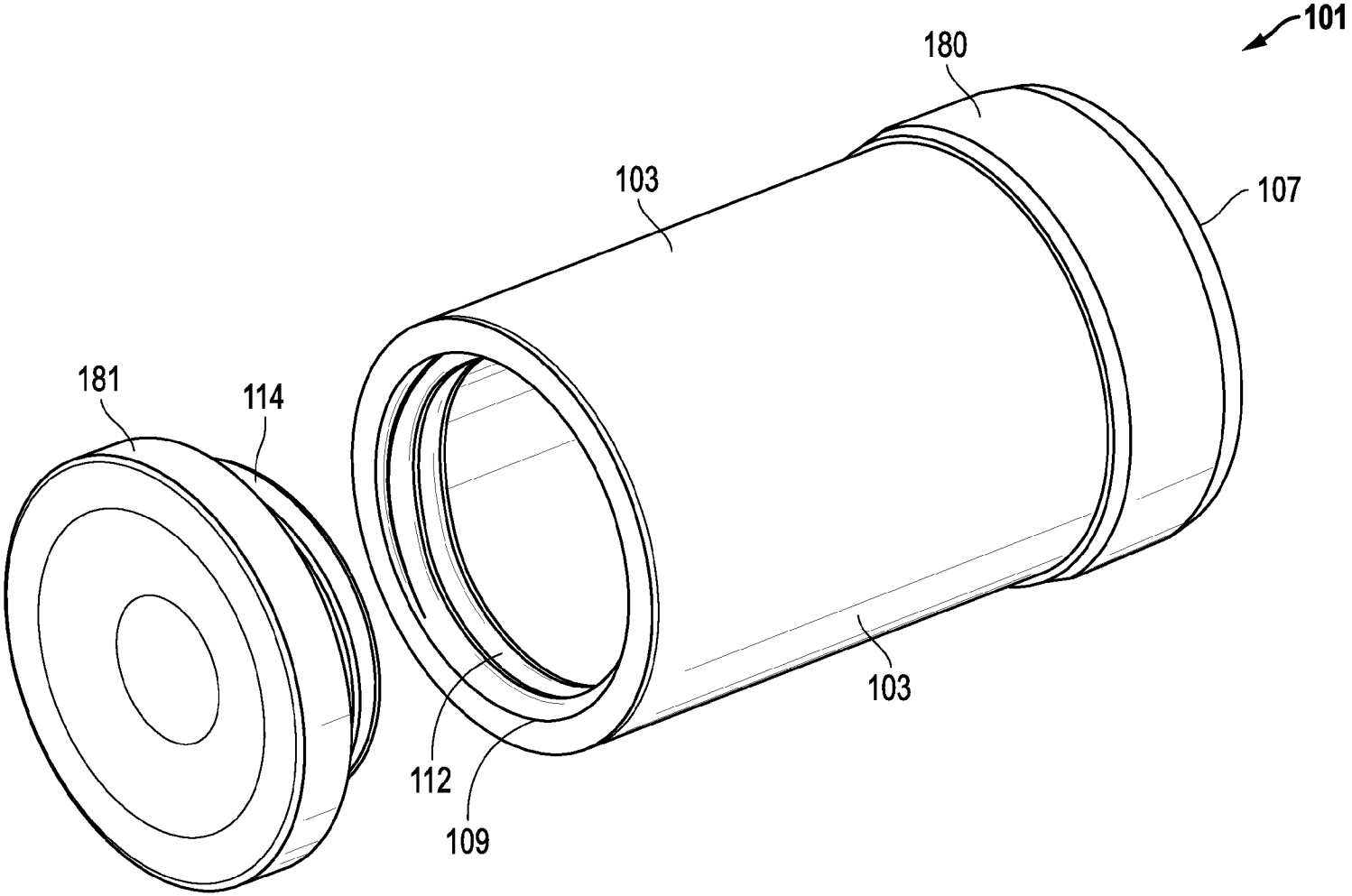

FIG. 5 illustrates a plot showing the improved results associated with using a device of the present disclosure. Device 10 is referred to as a "chiller puck" in this example. Tests were performed observing the temperature increase versus time of a beverage can. The control was a naked can that used no additional cooling mechanism. The can was then tested with a chiller puck, alone with a "coozie" or sleeve having no chiller puck, and then with a coozie combined with the chiller puck. The results clearly show a much more desirable temperature versus time profile using the chiller puck. Even still in combination with a coozie, the benefits of the puck are the dominant factor offering almost identical heat rejection profile.

Figure 9:
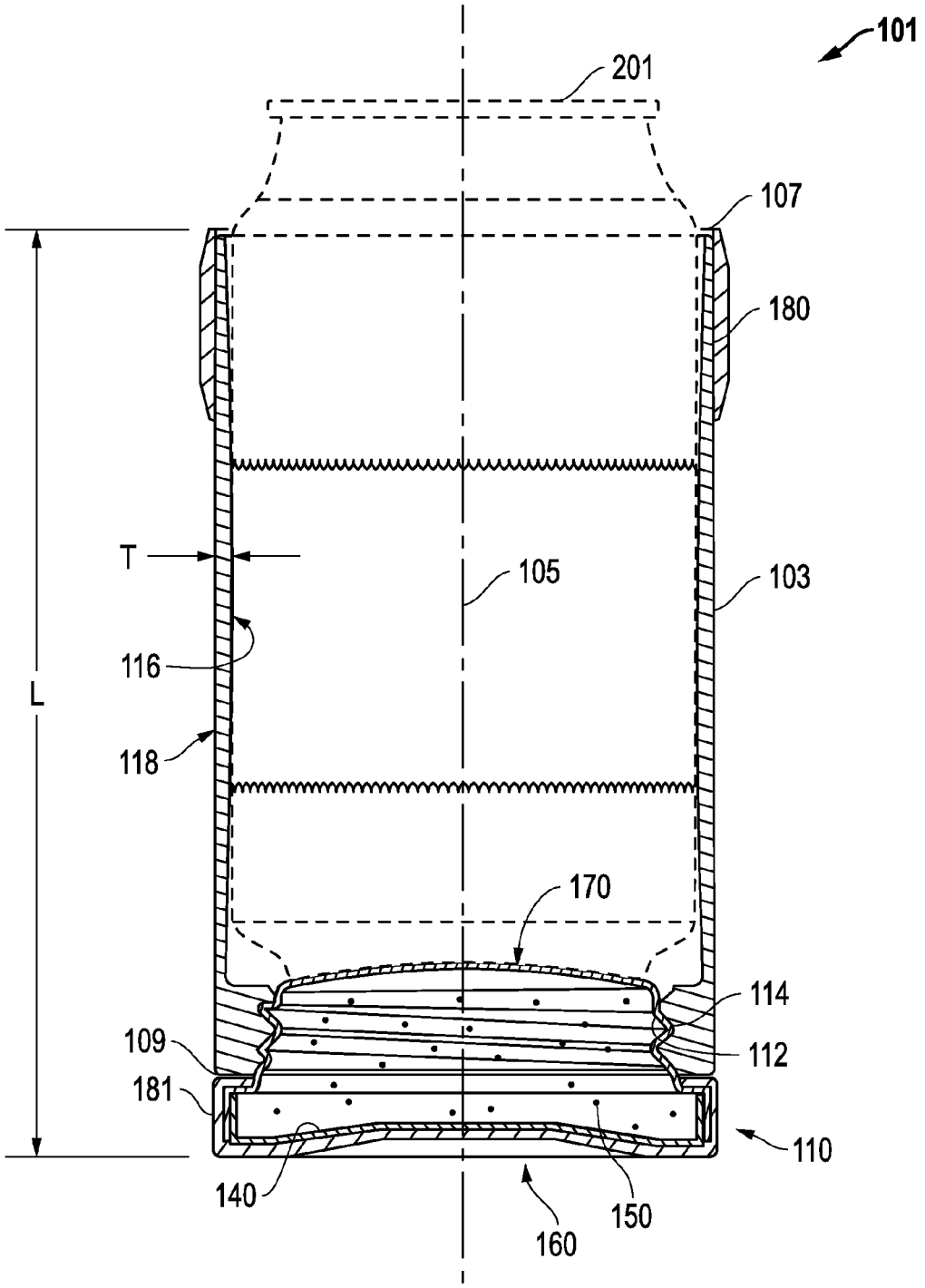
FIG. 9 is a sectional side view of an embodiment of the device of FIG. 6 with a beverage can installed.

FIGS. 6-9 depict alternative embodiments. For example, a device 101 for a beverage container 201 (FIG. 9) may include a tubular member 103 that is insulated and has an axis 105. The tubular member may further include an upper axial end 107 and a lower axial end 109. Both the upper and lower axial ends 107, 109 can be open, such that tubular member 103 is hollow. The tubular member 103 may be configured to receive and insulate the beverage container 201 therein, as shown in FIG. 9. For example, the beverage container is a can or bottle. Tubular member 103 also may be provided with a ledge, shelf or lip near its lower axial end 109. The ledge, shelf or lip can act as a 'stop' for the beverage container 201, and prevent it from falling through the tubular member 103 when a base 110 is removed from tubular member 103.

Embodiments of the base 110 may be removably coupled to the lower axial end 109 of the tubular member 103 to close the lower axial end 109. The base 110 may include an interior compartment 140 (FIG. 9) containing a fluid 150. The fluid 150 may be permanently sealed therein. The compartment 140 may include a plug to accomplish the seal. The fluid 150 can have a freezing point of about 0° C. or less. In other versions, the freezing point of the fluid 150 can be in a range of about −1° C. to about −30° C.

Embodiments of the fluid 150 may comprise a liquid or gel having a high potential heat value and a high specific heat capacity. The fluid may have good water retention properties and may be reusable. The fluid can be non-toxic, non-polluting and a non-irritant to human contact. The fluid may comprise water and additives that cause the water to remain a thick gel throughout use, instead of transitioning between a solid and a free-flowing liquid like ordinary water. Such a gel may be formed from non-toxic materials that will not liquefy, and therefore will not spill easily or cause contamination if the container breaks. For example, the gel may be made by adding hydroxyethyl cellulose (e.g., cellusize) or vinyl-coated silica gel to water.

One or more of the bases 110 may be interchangeably coupled to the tubular member 103. Such a configuration may allow a user to replace a first base that is no longer capable of serving as a chilling device for a beverage container, with a second base.

In some embodiments, the base 110 and lower axial end 109 may be provided with engagement features. For example, the engagement features may include threads, snaps, etc. In a particular version, interior threads 112 are formed in lower axial end 109. The base 110 can include exterior threads 114 to removably couple the base 110 to the tubular member 103. In a version, both the tubular member 103 and the base 110 can be formed from stainless steel.

Embodiments of an interior surface 116 of the tubular member 103 can be convex. A thickness T between the interior surface 116 and an exterior surface 118 of the tubular member 103 can vary. For example, thickness T can vary from about 0.5 mm to about 3 mm. In a particular embodiment, the interior surface 116 of the tubular member 103 can have a parabolic sectional shape from approximately the upper end 107 to approximately the lower end 109.

In still another version, the tubular member 103 may comprise an inner sleeve (represented by interior surface 116) coupled to an outer sleeve (represented by exterior surface 118). In an embodiment, the inner and outer sleeves can be welded and/or crimped together. In one embodiment, an exterior surface 118 of the tubular member 103 can be cylindrical. Tubular member 103 may include a vacuum.

In some embodiments, a bottom 160 (FIG. 9) of the base 110 can be flat. In other versions, a top 170 of the base 110 can be substantially flat, or it can be convex, such as a dome-like shape. The top 170 of the base 110 can be configured to contact a bottom of the beverage container 201. Such configurations of the base also may allow for thermal expansion and contraction of the materials and the permanently contained fluid. This design may help maintain consistent dimensions for the coupling devices, such as the diameter and size of the threads.

In one version, an axial length L of the tubular member 103 can be configured to be about the same or less than an axial length of the container 201. For example, axial length L can be about 50% to about 100% of the axial length of the beverage container 201.

Embodiments of device 101 may further include an elastomer 180. The elastomer may be mounted to at least one of the tubular member 103 and the base 110. For example, the elastomer 180 may include an elastomeric collar. The elastomer 180 can be from a thermoplastic elastomer. The elastomer 180 may include a plurality of elastomers, such as a plurality of elastomeric collars 180, 181. In a version, elastomeric collar 180 may be located adjacent the upper end 107 on an exterior of the tubular member 103. Elastomeric collar 180 may extend axially beyond the upper end 107 of the tubular member 103. The extension of elastomeric collar 180 beyond the upper end 107 may comprise a small annular lip to help retain the can 201, and retain (help insulate) a desired temperature for the contents of the can 201. Such designs may also assist in retaining any moisture condensation on the can within the device 101.

A version of the elastomeric collar 181 can envelope the base 110. Such a version may be configured to not interfere with any coupling (e.g., threads 114) extending from the base 110. In another version, the collar 181 can protrude from base 110 so connect the base to the tubular member 103 via friction.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A device for a beverage container, comprising:

a tubular member that is insulated and has an axis, an upper axial end and a lower axial end, both the upper and lower axial ends are open, and the tubular member is configured to receive and insulate a beverage container therein;

a base removably coupled to the lower axial end of the tubular member to close the lower axial end, the base having an interior compartment containing a fluid permanently sealed therein, the fluid having a freezing point of about 0° C. or less; and an interior surface of the tubular member is convex, such that a thickness between the interior surface and an exterior surface of the tubular member varies, with a smallest thickness adjacent the upper and lower axial ends, and a largest thickness between the upper and lower axial ends.

2. The device of claim 1, wherein an interior surface of the tubular member has a symmetrical parabolic sectional shape from approximately the upper axial end to approximately the lower axial end.

3. The device of claim 1, wherein the tubular member comprises an inner sleeve coupled to an outer sleeve, and the inner and outer sleeves are welded or crimped together.

4. The device of claim 1, wherein a bottom of the base is flat, a top of the base is convex, and the top of the base is configured to contact a bottom of the beverage container.

5. The device of claim 1, wherein an axial length of the tubular member is configured to be about 50% to about 100% of an axial length of the beverage container.

6. The device of claim 1, wherein the freezing point of the fluid is in a range of about −1° C. to about −30° C.

7. The device of claim 1, further comprising an elastomer mounted to at least one of the tubular member and the base.

8. The device of claim 7, wherein the elastomer is an elastomeric collar and is formed from a thermoplastic elastomer.

9. The device of claim 8, wherein the elastomeric collar comprises a plurality of elastomeric collars.

10. The device of claim 8, wherein the elastomeric collar is located adjacent the upper end on an exterior of the tubular member, and extends axially beyond the upper end of the tubular member.

11. The device of claim 8, wherein the elastomeric collar envelopes the base other than a coupling extending from the base.

12. A device for a beverage container, comprising:

a tubular member that is insulated and has an axis, an upper axial end and a lower axial end, both the upper and lower axial ends are open, and the tubular member is configured to receive and insulate a beverage container therein;

a base removably coupled to the lower axial end of the tubular member to close the lower axial end, the base having an interior compartment containing a fluid permanently sealed therein, the fluid having a freezing point of about 0° C. or less, and a bottom of the base is flat, a top of the base is convex, and the top of the base is configured to contact a bottom of the beverage container; and an axial length of the tubular member is configured to be about 50% to about 100% of an axial length of the beverage container for serving a beverage from the beverage container while the beverage container is retained in the device.

13. The device of claim 12, wherein an interior surface of the tubular member is convex, such that a thickness between the interior surface and an exterior surface of the tubular member varies, with a smallest thickness at the upper and lower axial ends, and a largest thickness between the upper and lower axial ends.

14. The device of claim 12, wherein an interior surface of the tubular member has a symmetrical parabolic sectional shape from approximately the upper axial end to approximately the lower axial end.

15. The device of claim 12, further comprising elastomers mounted to the tubular member and the base, the elastomers comprise a thermoplastic elastomer, and one of the elastomers envelopes the base, other than a coupling extending from the base.

16. A device for a beverage container, comprising:

a tubular member that is insulated and has an axis, an upper axial end and a lower axial end, both the upper and lower axial ends are open, the tubular member is configured to receive and insulate a beverage container therein, and a thickness between an interior surface and an exterior surface of the tubular member varies, and the interior surface of the tubular member has a symmetrical parabolic sectional shape;

a base removably coupled to the lower axial end of the tubular member to close the lower axial end, the base having an interior compartment containing a fluid permanently sealed therein, the fluid having a freezing point of about 0° C. or less; and elastomers mounted to the tubular member and the base, and the elastomer mounted to the base envelopes the base, other than a coupling extending from the base.

17. The device of claim 16, wherein an axial length of the tubular member is configured to be not greater than 100% of an axial length of the beverage container.

18. The device of claim 16, wherein a bottom of the base is flat, a top of the base is convex, and the top of the base is configured to contact a concave bottom of the beverage container.

* * * * *